US008328532B2

(12) United States Patent
Sishtla

(10) Patent No.: US 8,328,532 B2
(45) **Date of Patent: *Dec. 11, 2012**

(54) COMPRESSOR MUFFLER

(75) Inventor: Vishnu M. Sishtla, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1113 days.

This patent is subject to a terminal disclaimer.

(21) Appl. No.: 11/665,957

(22) PCT Filed: Jan. 27, 2005

(86) PCT No.: PCT/US2005/003403

§ 371 (c)(1),
(2), (4) Date: Apr. 19, 2007

(87) PCT Pub. No.: WO2006/043962

PCT Pub. Date: Apr. 27, 2006

(65) Prior Publication Data

US 2009/0068028 A1 Mar. 12, 2009

Related U.S. Application Data

(63) Continuation-in-part of application No. PCT/US2004/034946, filed on Oct. 20, 2004.

(30) Foreign Application Priority Data

Oct. 20, 2004 (WO) ..... PCT/US2004/034946

(51) Int. Cl.
*F04B 39/00* (2006.01)
*F01N 1/10* (2006.01)
*F01N 1/24* (2006.01)

(52) U.S. Cl. ..... 417/312; 181/252; 181/256; 181/403

(58) Field of Classification Search ..... 417/403, 417/312; 18/230, 252, 256, 430; 181/230, 181/252, 256, 430
See application file for complete search history.

(56) References Cited

U.S. PATENT DOCUMENTS 1,953,543 A * 4/1934 Rensink ..... 96/383
(Continued)

FOREIGN PATENT DOCUMENTS

CN 2147356 11/1993
(Continued)

OTHER PUBLICATIONS

European Search Report for EP Patent Application No. 05712738.3.

(Continued)

*Primary Examiner* — Charles Freay
(74) *Attorney, Agent, or Firm* — Bachman & LaPointe, P.C.

(57) ABSTRACT

A compressor has first and second enmeshed rotors rotating about first and second axes to pump refrigerant to a discharge plenum. The compressor includes a muffler system comprising a sound absorbing first element and a sound absorbing second element. The second element at least partially surrounds the first element and defines a generally annular flow path portion between the first element and the second element At least one of the first and second elements comprises an expanded bead material.

20 Claims, 4 Drawing Sheets

U.S. PATENT DOCUMENTS

| | | | | |
|---|---|---|---|---|
| 2,014,368 | A | 9/1935 | Blundell | |
| 3,920,095 | A | 11/1975 | Clark | |
| 4,174,196 | A | 11/1979 | Mori et al. | |
| 4,513,841 | A * | 4/1985 | Shimoji et al. | 181/252 |
| 5,350,888 | A * | 9/1994 | Sager et al. | 181/247 |
| 5,507,151 | A | 4/1996 | Ring et al. | |
| 5,767,459 | A * | 6/1998 | Sell | 181/258 |
| 6,331,103 | B1 * | 12/2001 | Teraoka | 418/181 |
| 6,672,424 | B2 | 1/2004 | Gadefait et al. | |
| 6,799,657 | B2 | 10/2004 | Daniels | |
| 6,875,066 | B2 * | 4/2005 | Wolaver | 440/77 |
| 2004/0055815 | A1 * | 3/2004 | Sterling | 181/230 |
| 2004/0065504 | A1 * | 4/2004 | Daniels | 181/252 |

FOREIGN PATENT DOCUMENTS

| | | | |
|---|---|---|---|
| DE | 3401210 | A1 | 7/1985 |
| EP | 0037559 | A1 | 10/1981 |
| FR | 2713701 | A1 | 6/1995 |

OTHER PUBLICATIONS

European Office action for EP Patent Application No. 05712738.3, dated Mar. 22, 2012.

George S. Brady et al., Materials Handbook, McGraw Hill, pp. 374&375 , 1996.

European Office Action for EP05712738.3, dated Jun. 15, 2009.

* cited by examiner

COMPRESSOR MUFFLER

CROSS REFERENCE TO RELATED APPLICATION

This application is a Continuation-in-Part of PCT Application No. PCT/US04/34946, filed Oct. 20, 2004 and entitled "COMPRESSOR SOUND SUPPRESSION".

BACKGROUND OF THE INVENTION

The invention relates to compressors. More particularly, the invention relates to sound and vibration suppression in screw-type compressors.

In positive displacement compressors, discrete volumes of gas are: trapped at a suction pressure; compressed; and discharged at a discharge pressure. The trapping and discharge each may produce pressure pulsations and related noise generation. Accordingly, a well developed field exists in compressor sound suppression.

One class of absorptive mufflers involves passing the refrigerant flow discharged from the compressor working elements through an annular space between inner and outer annular layers of sound-absorptive material (e.g., fiber batting). US Patent Application Pub. No. 2004/0065504 A1 discloses a basic such muffler and then improved versions having integral helmholtz resonators formed within the inner layer. The disclosure of this '504 publication is incorporated by reference herein as if set forth at length.

SUMMARY OF THE INVENTION

Accordingly, one aspect of the invention involves a compressor having first and second enmeshed rotors rotating about first and second axes to pump refrigerant to a discharge plenum. The compressor includes a muffler system comprising a sound absorbing first element and a sound absorbing second element. The second element at least partially surrounds the first element and defines a generally annular flow path portion between the first element and the second element At least one of the first and second elements comprises an expanded bead material.

In various implementations, at least one of the first and second elements comprises a plurality of rings of porous expanded polypropylene. Along a majority of total longitudinal spans of the first and second elements, the first and second elements may have inboard and outboard surfaces that are essentially non-convergent and non-divergent. The muffler system may include a perforated sheet metal first sleeve between the first and second elements and a first wire reinforcement secured to the first sleeve. The first sleeve may be at an inboard boundary of the generally annular flow path portion. A perforated sheet metal second sleeve may be at an outboard boundary of the generally annular flow path portion and a second wire reinforcement is secured to the second sleeve.

Another aspect of the invention involves a compressor muffler element. The element has a stack of a plurality of rings of an expanded bead material.

In various implementations the expanded bead material may be porous expanded polypropylene. A foraminate metallic sleeve may be concentrically within or surrounding the rings. A spiral metallic reinforcement may be secured to a first surface of the sleeve. The reinforcement may contact an adjacent surface of the element. A first such element according may be an outer element and a second such element may be an inner element at least partially nested within the first element to define a flowpath segment between an inner surface of the first element and an outer surface of the second element. First and second such elements may be separated by a metallic divider and a third such element may be an inner element at least partially nested within the first and second elements to define a flowpath segment between an inner surface of the first element and an outer surface of the second element.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
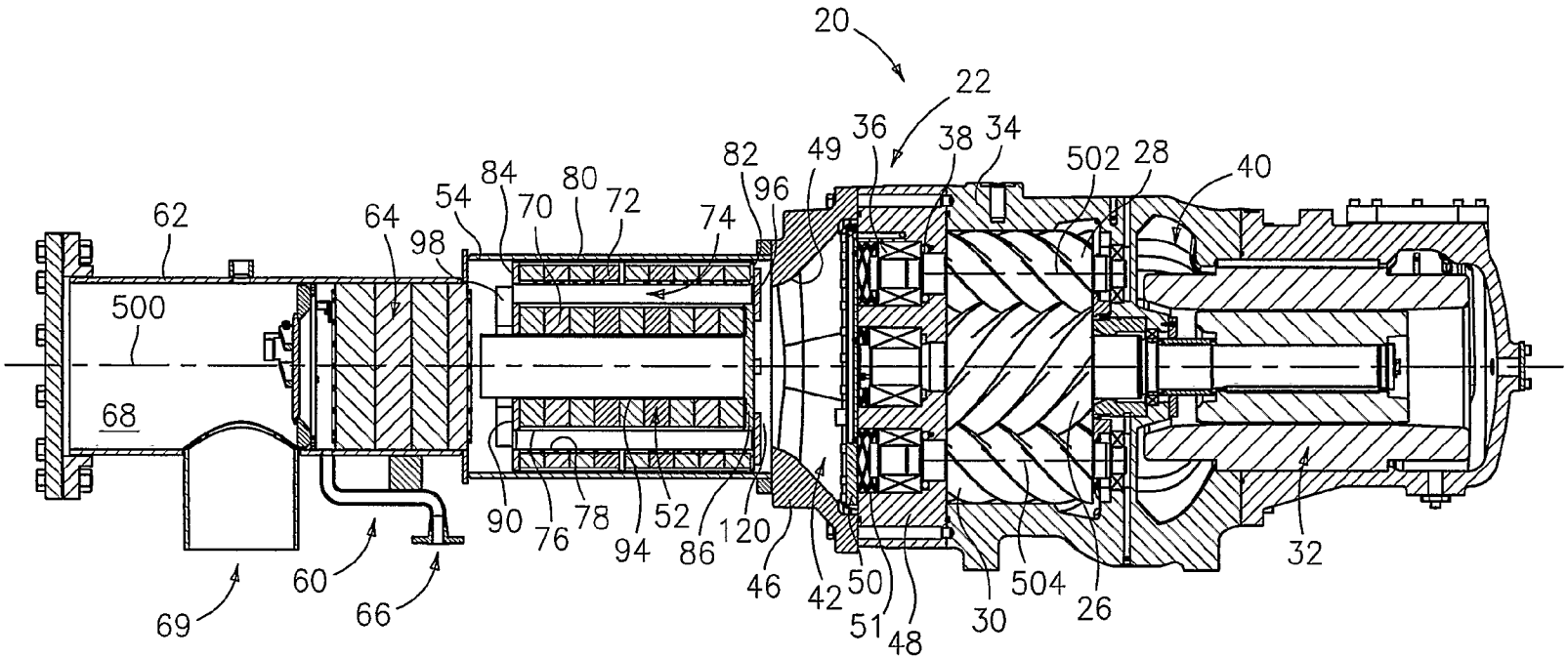
FIG. 1 is a longitudinal sectional view of a compressor.

FIG. 1 shows a compressor 20 having a housing or case assembly 22. The exemplary compressor is a three-rotor, screw-type, hermetic compressor having rotors 26, 28, and 30 with respective central longitudinal axes 500, 502, and 504. In the exemplary embodiment, the first rotor 26 is a male-lobed rotor driven by a coaxial electric motor 32 and, in turn, enmeshed with and driving the female-lobed rotors 28 and 30. In the exemplary embodiment, the male rotor axis 500 also forms a central longitudinal axis of the compressor 20 as a whole. The rotor working portions are located within a rotor case segment 34 of the case assembly 22 and may be supported by bearings 36 and sealed by seals 38 engaging rotor shafts at each end of the associated rotor working portion. When driven by the motor 32, the rotors pump and compress a working fluid (e.g., a refrigerant) along a flowpath from a suction plenum 40 to a discharge plenum 42. The flowpath is divided along distinct compression pockets or compression paths defined by associated pairs of the rotors between the suction and discharge plenums. Thus, the flow splits in the suction plenum and merges in the discharge plenum.

In the exemplary embodiment, the suction plenum 40 is located within an upstream end of the rotor case 34 and the discharge plenum is located generally within a discharge case 46 separated from the rotor case by a bearing case 48 and having a generally downstream-convergent interior surface 49. In the exemplary embodiment, a bearing cover/retainer plate 50 is mounted to a downstream end of the bearing case 48 to retain the bearing stacks. Downstream of the discharge case 46 is a muffler 52 in a muffler case 54. Downstream of the muffler 52 is an oil separator unit 60 having a case 62 containing a separator mesh 64. An oil return conduit 66 extends from the housing 62 to return oil stopped by the mesh 64 to a lubrication system (not shown). An outlet plenum 68 having an outlet port 69 is downstream of the mesh 64.

Figure 4A:
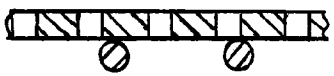
FIG. 4A is an enlarged view of a sleeve of the first metal subassembly taken along line 4A-4A of FIG. 4.
Figure 3:
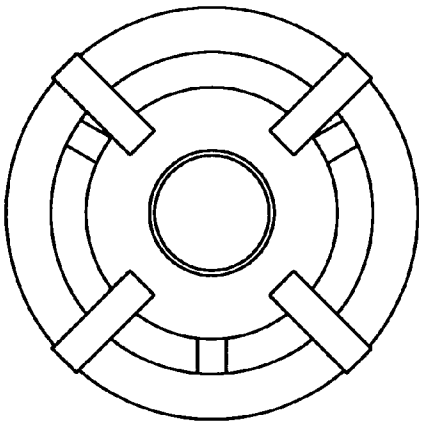
FIG. 3 is a downstream end view of the muffler of FIG. 2.
Figures 5, 5A:
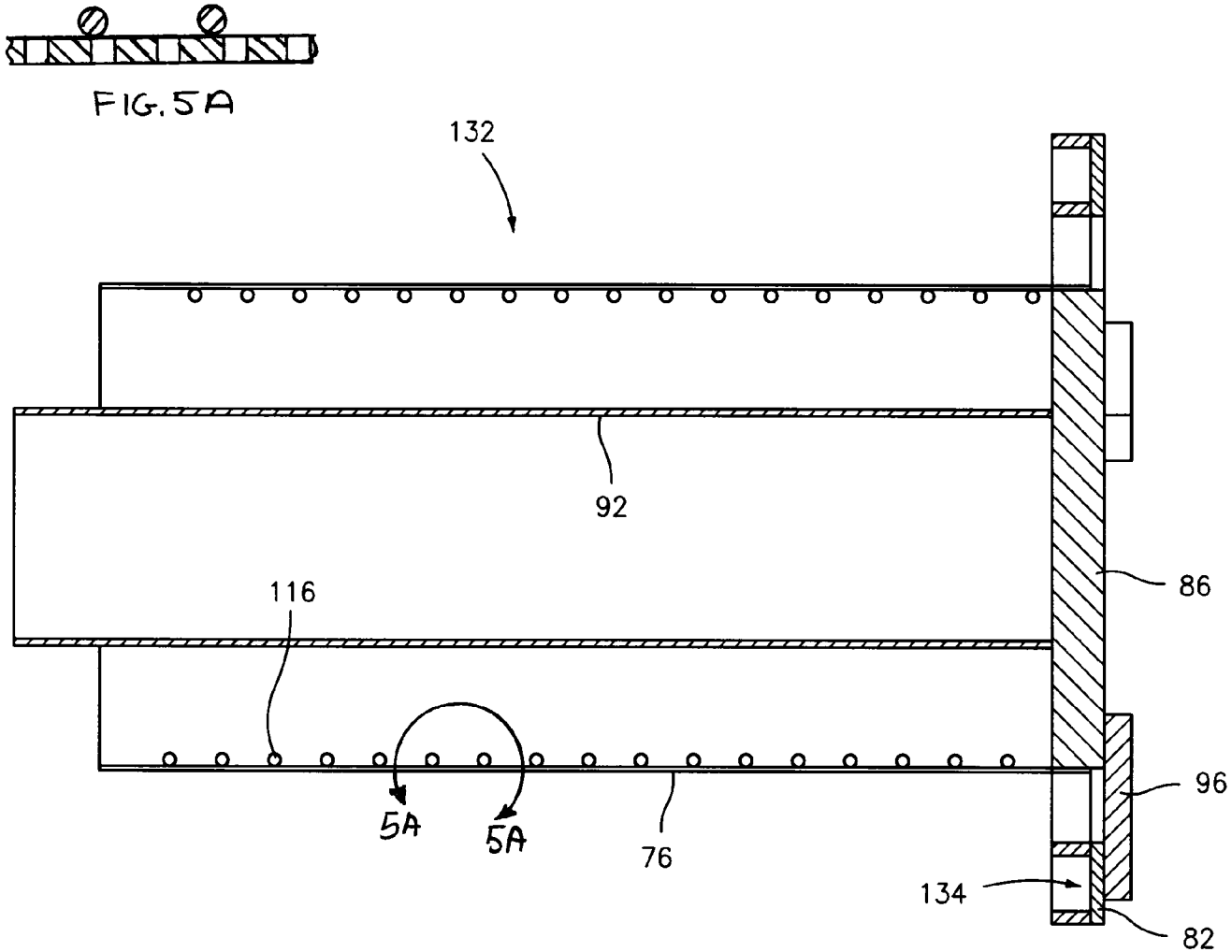
FIG. 5 is a longitudinal sectional view of a second metal subassembly of the muffler of FIG. 2.
FIG. 5A is an enlarged view of a sleeve of the first metal subassembly taken along line 5A-5A of FIG. 5.

The exemplary main muffler 52 includes annular inner and outer elements 70 and 72 separated by a generally annular space 74. These elements may be formed of sound absorption material. In the exemplary embodiment, the inner element 70 is retained and separated from the space 74 by an inner foraminate sleeve 76 (e.g., wire mesh or perforated/expanded metal sheeting) and the outer element 72 is similarly separated and retained by an outer foraminate sleeve 78. The holes of the foraminate sleeves 76 and 78 are, respectively, shown in FIGS. 4A and 5A without reference to any particular layout or formation method. In the exemplary embodiment, the outer element 72 is encased within an outer sleeve 80 telescopically received within the housing 54. The sleeves 80 and 78 are joined at upstream and downstream ends by annular plates 82 and 84. In the exemplary embodiment, the upstream end of the sleeve 76 is closed by a circular plate 86 and the downstream end closed by an annular plate 90. In the exemplary embodiment, a non-foraminate central core 94 (e.g., steel pipe) extends through the inner element 70 and protrudes beyond a downstream end thereof. At the upstream end of the main muffler, radially-extending connectors 96 join the circular plate 86 to the annular plate 82. At the downstream end, radially-extending connectors 98 connect the annular plates 84 and 90 to hold the inner and outer elements concentrically spaced apart to maintain the annular space 74.

In operation, compressed gas flow exits the compression pockets of the screw rotors 26, 28, 30 and flows into the discharge plenum 42. Upon exiting the compressor discharge plenum, the gas flows down the annular space 74. Upon exiting the muffler, the gas flow, which typically has entrained oil droplets, flows through the oil separating mesh 64. The mesh 64 captures any oil entrained in the gas and returns it to the oil management system by means of the conduit 66. The gas leaves the oil separating mesh and enters the plenum 68 and exits the outlet 69 toward the condenser (not shown).

Figure 2:
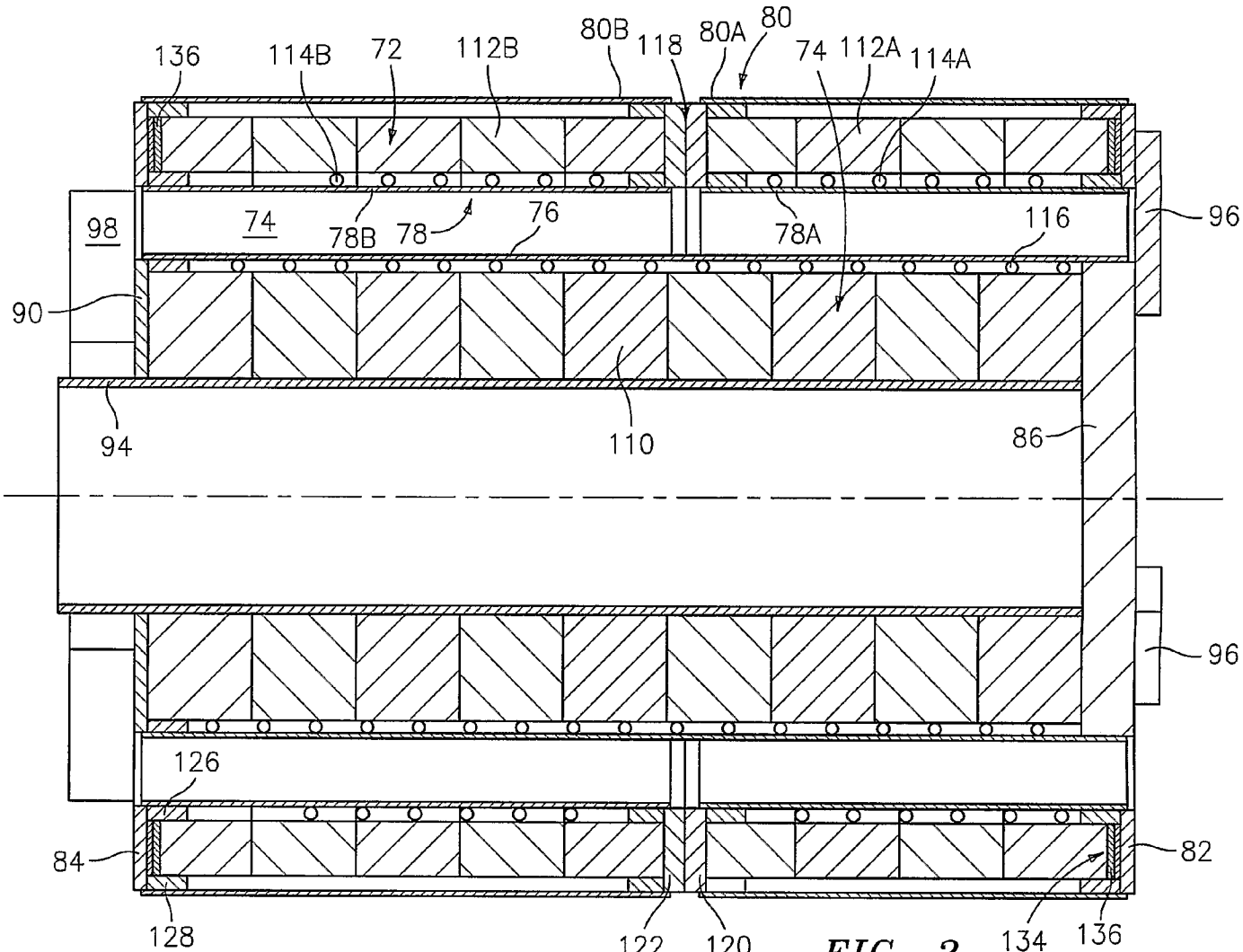
FIG. 2 is a longitudinal sectional view of a muffler of the compressor of FIG. 1.

FIG. 2 shows further details of the main muffler 52. The sound-absorbing material of the inner and outer elements are respectively formed by exemplary stacks of foam-like rings 110 and 112A, 112B. The exemplary rings 110 are formed in a single stack (e.g., of nine identical rings). The exemplary rings 112A and 112B are identical but positioned in distinct upstream and downstream stacks. Exemplary ring material is expanded polypropylene beads (e.g., material known as porous expanded polypropylene (PEPP)).

The exemplary sleeve 80 is formed in respective upstream and downstream sections 80A and 80B along the ring stacks. The exemplary sleeve 78 is similarly formed in upstream and downstream sections 78A and 78B. Exemplary sleeve sections 78A and 78B are, along their outboard surfaces, circumferentially reinforced by a metallic spiral reinforcement 114A and 114B. Similarly, the sleeve 76 may, along its inboard surface be reinforced by a metallic spiral element 116.

In the exemplary muffler, the two stacks of outer rings 112A and 112B are separated by a divider 118 comprising a pair of annular plates 120 and 122. In the exemplary muffler, each of the annular plates 82, 84, 120, and 122 is secured to associated short inboard and outboard metal rings 126 and 128 extending partially inboard and outboard, respectively, of the adjacent ring 112A or 112B to form a longitudinally-open annular channel.

Figure 4:
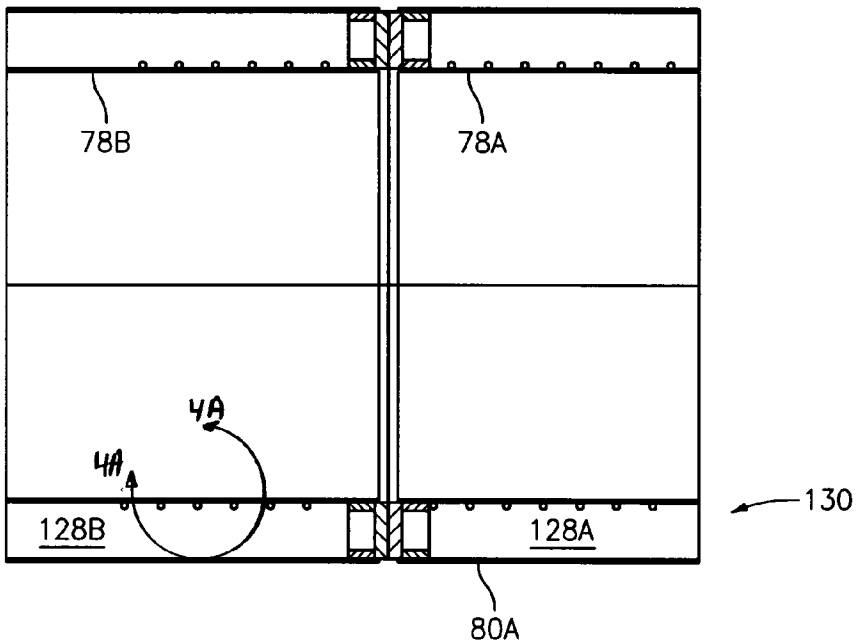
FIG. 4 is a longitudinal sectional view of a first metal subassembly of the muffler of FIG. 2.

In an exemplary sequence of muffler assembly, the annular plates 82, 84, 120, and 122 are welded to their associated rings 126 and 128. Respective downstream and upstream end portions of the sleeve sections 78A and 78B may be telescopically inserted within the central apertures of respective plates 120 and 122 and their associated inboard rings 126 and welded thereto. The reinforcements 114A and 114B may then be wrapped around the sleeve sections 78A and 78B and welded thereto. The sleeve sections 80A and 80B may then be installed over the plates 120 and 122 and their associated outer rings 126 and welded thereto to define annular compartments 128A and 128B (FIG. 4). The resultant two subassemblies may then be welded end-to-end (e.g., with the downstream face of the plate 120 contacting the upstream face of the plate 122) to provide an outer element metallic assembly 130 (FIG. 4).

An inner element metallic assembly 132 (FIG. 5) may also be formed. The tube 94 may be welded to the downstream face of the plate 86. An upstream end portion of the sleeve 76 may be placed over the outer periphery of the plate 86 and welded thereto. The connectors 96 may be welded to the upstream face of the plate 82 and then to the upstream face of the plate 86 to position the plate 86 concentrically within the plate 82 and its associated rings. The reinforcement 116 may be inserted within the sleeve 76 and welded thereto. The relatively smaller diameter of the sleeve 76 compared with the sleeve 78 may provide the sleeve 76 with greater structural integrity. Thus, there may be less need for reinforcement of the sleeve 76. Also, it is desirable that the reinforcement be opposite the space 74 so that the reinforcement does not excessively restrict the refrigerant flow. Such a location places the reinforcement 116 within the sleeve 76 and increases the difficulty of welding relative to an external placement. This difficulty, combined with a lesser need, renders the reinforcement 116 of a substantially lower cost/benefit value and makes it particularly omitable. With the two metal assemblies prepared, the muffler may be finally assembled. The stack of rings 112A is inserted within the first annular compartment 128A. One or more insulator rings 136 (e.g., a synthetic, non-asbestos, non-metallic, material in a resilient binder (e.g., neoprene or nitrile rubber) such as is available under the trademark BLUE-GARD 3300 of Garlock Sealing Technologies, Palmyra, New York, may be installed atop the stack or within the annular channel 134 (FIG. 5) formed by the plate 82 and its associated rings. The assembly 130 may then be installed to the assembly 132 with upstream portions of the sleeves 78A and 80A receiving the annular plate 82 and its associated rings. The sleeves may then be welded to the annular plate. During this welding, the insulator rings 136 protect the upstreammost ring 112A from thermal damage. The rings 112B may then be inserted into the compartment 128B. Also, the rings 110 may be installed over the tube 94 within the sleeve 76. The downstream end assembly may then be put in place (insulator rings 136 being pre-installed, for example). An exemplary securing involves welding the inner aperture of the plate 90 to the tube 94 and an outer perimeter portion of the plate 84 to the downstream end portion of the sleeve 80B.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Accordingly, other embodiments are within the scope of the following claims.

What is claimed is:

1. A compressor comprising:

a first rotor having a first rotational axis;

a second rotor having a second rotational axis and enmeshed with the first rotor;

a discharge plenum; and a muffler system comprising:

a sound-absorbing first element; and a sound-absorbing second element at least partially surrounding the first element and defining a generally annular flow path portion between the first element and second element, wherein at least one of the first and second elements comprises an expanded bead material.

2. The compressor of claim 1 wherein:

at least one of the first and second elements comprises a plurality of rings of porous expanded polypropylene.

3. The compressor of claim 1 wherein:

along a majority of a total longitudinal span of the first element, the first element has inboard and outboard surfaces that are essentially non-convergent and non-divergent; and along a majority of a total longitudinal span of the second element, the second element has inboard and outboard surfaces that are essentially non-convergent and non-divergent.

4. The compressor of claim 1 wherein:

the muffler system includes a perforated sheet metal first sleeve between the first and second elements and a first wire reinforcement secured to the first sleeve.

5. The compressor of claim 4 wherein:

the first sleeve is at an inboard boundary of the generally annular flow path portion; and a perforated sheet metal second sleeve is at an outboard boundary of the generally annular flow path portion and a second wire reinforcement is secured to the second sleeve.

6. A compressor muffler element comprising:

a stack of a plurality of rings of an expanded bead material stacked against each other.

7. The compressor muffler element of claim 6 in combination with:

a metallic assembly including a welded portion and at least one of:

a foraminate sleeve extending within the respective apertures of the rings; and a foraminate sleeve surrounding the respective peripheries of the rings; and a non-asbestos, non-metallic, insulator different from the rings and between an end one of the rings and said welded portion of the metallic assembly.

8. The compressor muffler element of claim 6 wherein:

the expanded bead material is porous expanded polypropylene.

9. The compressor muffler element of claim 6 in combination with:

a foraminate metallic sleeve concentrically within or surrounding the rings; and a spiral metallic reinforcement secured to a first surface of the sleeve.

10. The combination of claim 9 wherein:

the reinforcement contacts an adjacent surface of the element.

11. A compressor muffler comprising:

a first element according to claim 6 being an outer element; and a second element according to claim 6 being an inner element at least partially nested within the first element to define a flowpath segment between an inner surface of the first element and an outer surface of the second element.

12. A compressor muffler comprising:

a first element according to claim 6;

a second element according to claim 6 separated from the first element by a metallic divider; and a third element according to claim 6 being an inner element at least partially nested within the first and second elements to define a flowpath segment between an inner surface of the first element and an outer surface of the second element.

13. The compressor muffler of claim 12 wherein:

the metallic divider comprises a pair of annular plates.

14. The compressor muffler of claim 13 wherein:

each plate of the pair of annular plates is secured to associated inboard and outboard metal rings to form an associated longitudinally-open annular channel.

15. The compressor muffler of claim 14 wherein:

each plate of the pair of annular plates is welded to an associated inner sleeve and an associated outer sleeve.

16. The compressor muffler of claim 15 wherein:

the first element and the second element combine to form an outer element along the flowpath segment.

17. The compressor muffler of claim 14 wherein:

the first element and the second element combine to form an outer element along the flowpath segment.

18. The compressor muffler of claim 13 wherein:

each plate of the pair of annular plates is welded to an associated inner sleeve and an associated outer sleeve.

19. The compressor muffler of claim 13 wherein:

the first element and the second element combine to form an outer element along the flowpath segment.

20. The compressor muffler of claim 12 wherein:

the first element and the second element combine to form an outer element along the flowpath segment.

* * * * *